US008135307B2

(12) United States Patent
Inoue et al.

(10) Patent No.: US 8,135,307 B2
(45) Date of Patent: Mar. 13, 2012

(54) TRANSFER BELT DEVICE, METHOD OF ASSEMBLING THE SAME, AND IMAGE FORMING APPARATUS

(75) Inventors: Tomofumi Inoue, Osaka (JP); Takeshi Sakashita, Osaka (JP); Mitsutoshi Kichise, Osaka (JP); Yuuji Meguro, Ibaraki (JP); Takeru Muramatsu, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 929 days.

(21) Appl. No.: 12/125,653

(22) Filed: May 22, 2008

(65) Prior Publication Data

US 2008/0317521 A1 Dec. 25, 2008

(30) Foreign Application Priority Data

Jun. 22, 2007 (JP) ..... 2007-165163
Dec. 28, 2007 (JP) ..... 2007-341292

(51) Int. Cl.
*G03G 15/08* (2006.01)
*G03G 15/01* (2006.01)

(52) U.S. Cl. ..... 399/121; 399/302; 399/303

(58) Field of Classification Search ..... 399/116, 399/121, 162, 165, 288, 302, 303, 308, 313, 399/329
See application file for complete search history.

(56) References Cited

U.S. PATENT DOCUMENTS 4,563,077 A * 1/1986 Komada ..... 399/165
4,804,993 A * 2/1989 Kenin et al. ..... 399/116
5,991,575 A * 11/1999 Okiyama et al. ..... 399/165
6,269,231 B1 * 7/2001 Castelli et al. ..... 399/165
6,560,428 B2 * 5/2003 Sanchez-Banos et al. .... 399/165
6,704,528 B1 3/2004 Kawamura et al.
2007/0183816 A1 8/2007 Hatayama et al.
2007/0269233 A1 11/2007 Sakashita et al.
2008/0003022 A1 1/2008 Sakashita et al.
2008/0028967 A1 2/2008 Sakashita et al.
2008/0050158 A1 2/2008 Hatayama et al.

FOREIGN PATENT DOCUMENTS

JP 63137273 A * 6/1988
JP 5-238582 9/1993
JP 2000047528 A * 2/2000
JP 2000284637 A * 10/2000
JP 2000-330395 11/2000
JP 2002-258629 9/2002
JP 2005-156767 6/2005
JP 3687397 6/2005
JP 2005351302 A * 12/2005
JP 2006-301545 11/2006
JP 2007-72337 3/2007

OTHER PUBLICATIONS

U.S. Appl. No. 12/250,046, filed Oct. 13, 2008, Tsuda.
U.S. Appl. No. 12/142,354, filed Jun. 19, 2008, Kichise, et al.

* cited by examiner

*Primary Examiner* — Robert Beatty
(74) *Attorney, Agent, or Firm* — Oblon, Spivak, McClelland, Maier & Neustadt, L.L.P.

(57) ABSTRACT

Rollers including a tension roller are arranged in parallel. A pair of supporting members supports both ends of the rollers. A transfer belt is supported by the rollers. A biasing member applies a tension to the transfer belt by biasing the tension roller in a predetermined direction. The tension roller is movably supported in a straight-line direction. The biasing member is arranged in an area surrounded by the supporting members and the transfer belt in a direction of traversing from one supporting member to other supporting member.

14 Claims, 11 Drawing Sheets

TRANSFER BELT DEVICE, METHOD OF ASSEMBLING THE SAME, AND IMAGE FORMING APPARATUS

CROSS-REFERENCE TO RELATED APPLICATIONS

The present application claims priority to and incorporates by reference the entire contents of Japanese priority documents, 2007-165163 filed in Japan on Jun. 22, 2007 and 2007-341292 filed in Japan on Dec. 28, 2007.

BACKGROUND OF THE INVENTION

1. Field of the Invention

The present invention relates to a transfer belt device, a method of assembling the transfer belt device, and an image forming apparatus that includes the transfer belt device.

2. Description of the Related Art

A direct transfer system is well known as a transfer system for a typical image in a color image forming apparatus. In the direct transfer system, toner images of different colors which are respectively formed on a plurality of photosensitive drums are transferred, by directly superimposing in a sequence, onto a sheet that is conveyed by a transfer belt (transfer conveying belt). Due to this, a color image is formed. Furthermore, an indirect transfer system is used as another transfer system. In the indirect transfer system, the toner images of different colors, formed similarly as mentioned earlier, are transferred, by sequentially superimposing in the sequence, onto a transfer belt (intermediate transfer belt). Due to this, the color image is formed. The color image is bulk transferred onto the sheet.

The transfer belt used in the direct transfer system or the indirect transfer system is wound around a plurality of rollers including a tension roller. By using a biasing member such as a spring, the tension roller is biased and a predetermined tensile force is applied to the transfer belt.

In recent years, along with an enhancement in miniaturization of the image forming apparatus, miniaturization of the transfer belt is also called for. As disclosed in Japanese Patent Application Laid-open No. 2002-258629 or Japanese Patent Application Laid-open No. 2007-72337, the biasing member such as the spring is positioned on an inner side, which has become a dead space, of the transfer belt to miniaturize an existing transfer belt.

If a spring having a high spring constant is used as the biasing member of the tension roller, a biasing force easily fluctuates due to variations in the dimensional tolerance of components and positioning accuracy errors. For example, if the biasing force of a pair of springs that biases both ends of the tension roller fluctuates due to variations in the dimensional tolerance of the components and the positioning accuracy errors and a balance between the springs disrupts, a running stability of the transfer belt is likely to reduce. Due to this, problems such as deterioration of the transfer belt and degradation of the quality of an image that is formed on the sheet occur.

To overcome the problems, it is desirable to use a spring having a low spring constant as the biasing member of the tension roller. However, to obtain a predetermined biasing force by using the spring having the low spring constant, it is necessary to use a spring that is marginally long.

In a structure, which is mentioned in any one of the technologies mentioned earlier, in which the spring is positioned in a direction that is orthogonal to the rollers, if the long spring is used, for avoiding an interference of the spring with the rollers, the spring needs to be positioned by shifting to a vertical direction such that the spring intersects the rollers. Thus, in such a method of positioning the spring, changing a design such as further thinning and reducing a flat space, which is formed in between the transfer belt, is difficult.

As disclosed in Japanese Patent Application Laid-open No. 2000-259053, if the tension roller is connected to one end of an L-shaped lever member that is turnably supported around a shaft that is parallel to a shaft of the tension roller and if the tension roller is pressed on the transfer belt by causing the lever member to turn by using a tension spring that is arranged inside the transfer belt, a space is obtained in the vertical direction. Thus, further thinning and reducing the flat space, which is formed in between the transfer belt, is difficult.

SUMMARY OF THE INVENTION

It is an object of the present invention to at least partially solve the problems in the conventional technology.

According to an aspect of the present invention, there is provided a transfer belt device including a plurality of rollers arranged in parallel including a tension roller; a pair of supporting members that supports both ends of the rollers; a transfer belt that is supported by the rollers; and a biasing member that applies a tension to the transfer belt by biasing the tension roller in a predetermined direction. The tension roller is movably supported in a straight-line direction. The biasing member is arranged in an area surrounded by the supporting members and the transfer belt in a direction of traversing from one supporting member to other supporting member.

Furthermore, according to another aspect of the present invention, there is provided an image forming apparatus including a transfer belt device that includes a plurality of rollers arranged in parallel including a tension roller; a pair of supporting members that supports both ends of the rollers; a transfer belt that is supported by the rollers; and a biasing member that applies a tension to the transfer belt by biasing the tension roller in a predetermined direction. The tension roller is movably supported in a straight-line direction. The biasing member is arranged in an area surrounded by the supporting members and the transfer belt in a direction of traversing from one supporting member to other supporting member.

Moreover, according to still another aspect of the present invention, there is provided a method of assembling a transfer belt device that includes a transfer belt supported on a plurality of rollers including a tension roller arranged in parallel on a pair of supporting members. The method includes linking a biasing member arranged in an area surrounded by prior arrangement positions of the supporting members and the transfer belt in a direction of traversing from one supporting member to other supporting member and a link unit; holding the link unit in a predetermined position resisting a biasing force of the biasing member by a position holding unit; linking the tension roller to the link unit in a state in which the link unit is held in a predetermined position; arranging the transfer belt on outer peripheries of the rollers including the tension roller; releasing a held position of the link unit after arranging the transfer belt on the outer peripheries of the rollers; and applying a tension to the transfer belt by the biasing force of the biasing member being transferred to the tension roller upon releasing the held position of the link unit.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
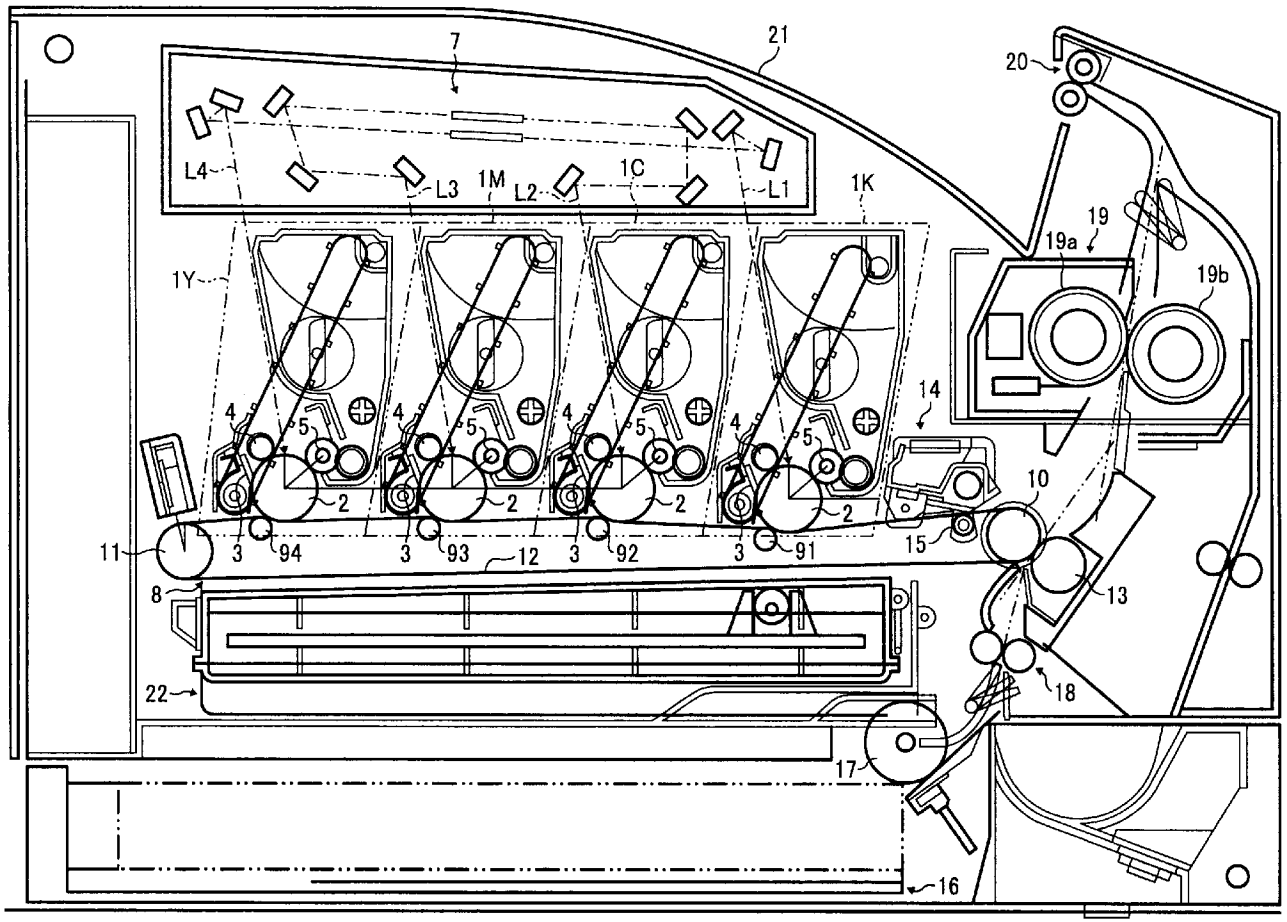
FIG. 1 is a schematic diagram for explaining an entire structure of an image forming apparatus that includes a transfer belt device according to an embodiment of the present invention.

Exemplary embodiments of the present invention are explained in detail below with reference to the accompanying drawings. FIG. 1 is a schematic diagram for explaining an entire structure of an image forming apparatus that includes a transfer belt device according to an embodiment of the present invention. As shown in FIG. 1, the image forming apparatus includes four process units 1K, 1C, 1M, and 1Y for forming images by using developing agents of black, cyan, magenta, and yellow color corresponding to a color separating element of a color image.

The process units 1K, 1C, 1M, and 1Y house therein toners of different colors. However, the process units 1K, 1C, 1M, and 1Y include a similar structure. The process unit 1K is explained as an example. The process unit 1K includes an image carrier 2, a cleaning unit 3, a charging unit 4, and a developing unit 5. The process unit 1K can be attached to and detached from a main body of the image forming apparatus.

An exposure unit 7 is positioned on an upper side of the process units 1K, 1C, 1M, and 1Y. The exposure unit 7 is positioned such that laser beams L1 to L4 are emitted from laser diodes based on image data.

Figure 2:
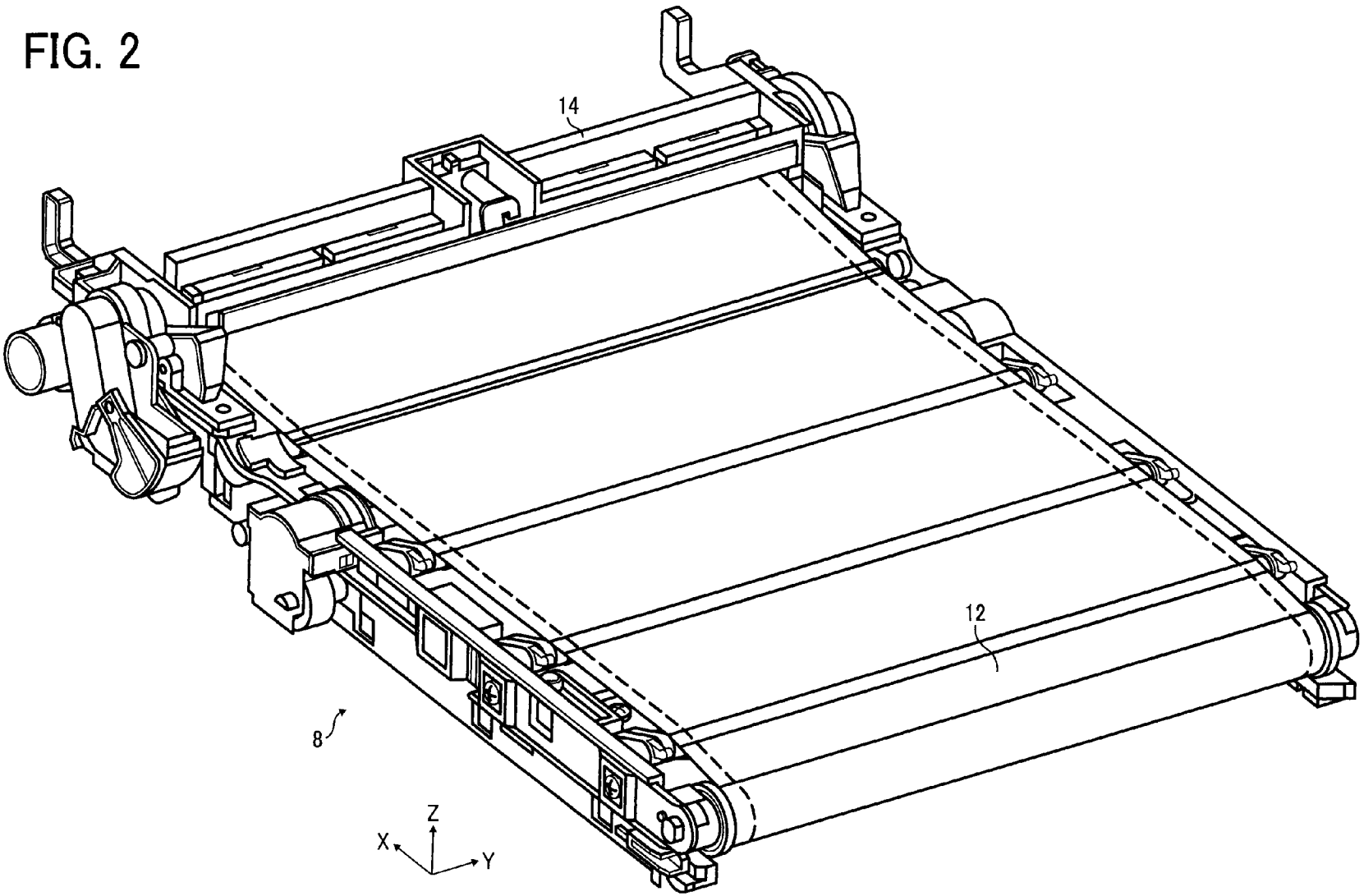
FIG. 2 is a schematic diagram of the transfer belt device.

Furthermore, a transfer belt device 8 is positioned on a lower side of the process units 1K, 1C, 1M, and 1Y. As shown in FIGS. 1 and 2, the transfer belt device 8 includes a transfer belt 12 for transferring toner images formed on the image carriers 2 (an indirect transfer system). The transfer belt 12 is wound around four primary transfer rollers 91 to 94 facing respective image carrier 2, a driving roller 10, a tension roller 11, and a cleaning backup roller 15. The transfer belt 12 is positioned such that the transfer belt 12 is rotatably driven. A secondary transfer roller 13 is positioned facing the driving roller 10 and a belt cleaning unit 14 is positioned facing the cleaning backup roller 15.

A sheet feeding cassette 16 that can house a plurality of sheets that are sheet-like recording mediums and a sheet feeding roller 17 that transfers sheets from the sheet feeding cassette 16 are positioned in a lower portion of the image forming apparatus. A pair of registration rollers 18 that stops the sheet is positioned in a path from the sheet feeding roller 17 until a nip between the secondary transfer roller 13 and the driving roller 10.

A fixing unit 19 is positioned on an upper side of the nip between the secondary transfer roller 13 and the driving roller 10. The fixing unit 19 includes a fixing roller 19*a*, which internally includes a not shown heat generating source such as a halogen lamp, and a pressure roller 19*b*, which rotates while touching the fixing roller 19*a* at a predetermined pressure.

A pair of sheet ejecting rollers 20 is positioned on an upper side of the fixing unit 19 for ejecting the sheets. The sheet ejecting rollers 20 is positioned such that the sheets ejected by the sheet ejecting rollers 20 are accumulated on a discharge tray 21 that is formed by causing a top cover to curve towards an inner direction.

A waste-toner collecting unit 22 is positioned between the transfer belt device 8 and the sheet feeding cassette 16 to retain a waste toner. A not shown waste toner transporting hose, which is extended from the belt cleaning unit 14, is connected to an inlet port of the waste-toner collecting unit 22.

When the sheet feeding roller 17 rotates based on sheet feeding signals from a not shown controller of the image forming apparatus, from the sheets, which are loaded in the sheet feeding cassette 16, only the sheet on the top most position is separated and is transferred to the registration rollers 18. If a tip of the sheet reaches a nip between the registration rollers 18, the sheet awaits for obtaining synchronization with the toner image formed on the transfer belt 12.

Image creation operations are explained below with the process unit 1K as an example. First, the charging unit 4 uniformly charges a surface of the image carrier 2 at high potential. Based on image data, the laser beam L1 is irradiated from the exposure unit 7 on the image carrier 2. Due to this, electric potential of the irradiated portion is decreased and an electrostatic latent image is formed. The developing unit 5 transfers a toner onto a surface portion of the image carrier 2 on which the electrostatic latent image is formed, thus forming (developing) a black toner image. The toner image formed on the image carrier 2 is then transferred onto the transfer belt 12. Similarly as in the process unit 1K, the toner images are formed on the image carriers 2 in the other process units 1C, 1M, and 1Y and the toner images of four colors are transferred onto the transfer belt 12 such that the four images are overlapped.

The cleaning units 3 remove a residual toner that is adhering to the surfaces of the image carriers 2 after an intermediate transfer process. Next, a neutralizing unit (not shown) neutralizes the image carriers 2 after cleaning.

The registration rollers 18 and the sheet feeding roller 17 resume driving and transfer the sheet to the secondary transfer roller 13 by obtaining synchronization with the toner image that is superimposed and transferred onto the transfer belt 12.

The secondary transfer roller 13 transfers the toner image that is superimposed and transferred, onto the transferred sheet.

Upon transferring the toner image, the sheet is conveyed to the fixing unit 19. The sheet transferred to the fixing unit 19 is sandwiched between the fixing roller 19*a* and the pressure roller 19*b*, and by applying heat and pressure, an unfixed toner image is fixed onto the sheet. Upon fixing the toner image, the sheet is transferred to the sheet ejecting rollers 20 from the fixing unit 19 and the sheet is ejected by the sheet ejecting rollers 20 in the discharge tray 21.

After the toner image on the transfer belt 12 is transferred onto the sheet, the belt cleaning unit 14 removes from the transfer belt 12, the residual toner, which is adhered to the transfer belt 12. The toner that is removed from the transfer belt 12 is conveyed by using a not shown waste-toner conveying unit and is collected in the waste-toner collecting unit 22.

Figure 3:
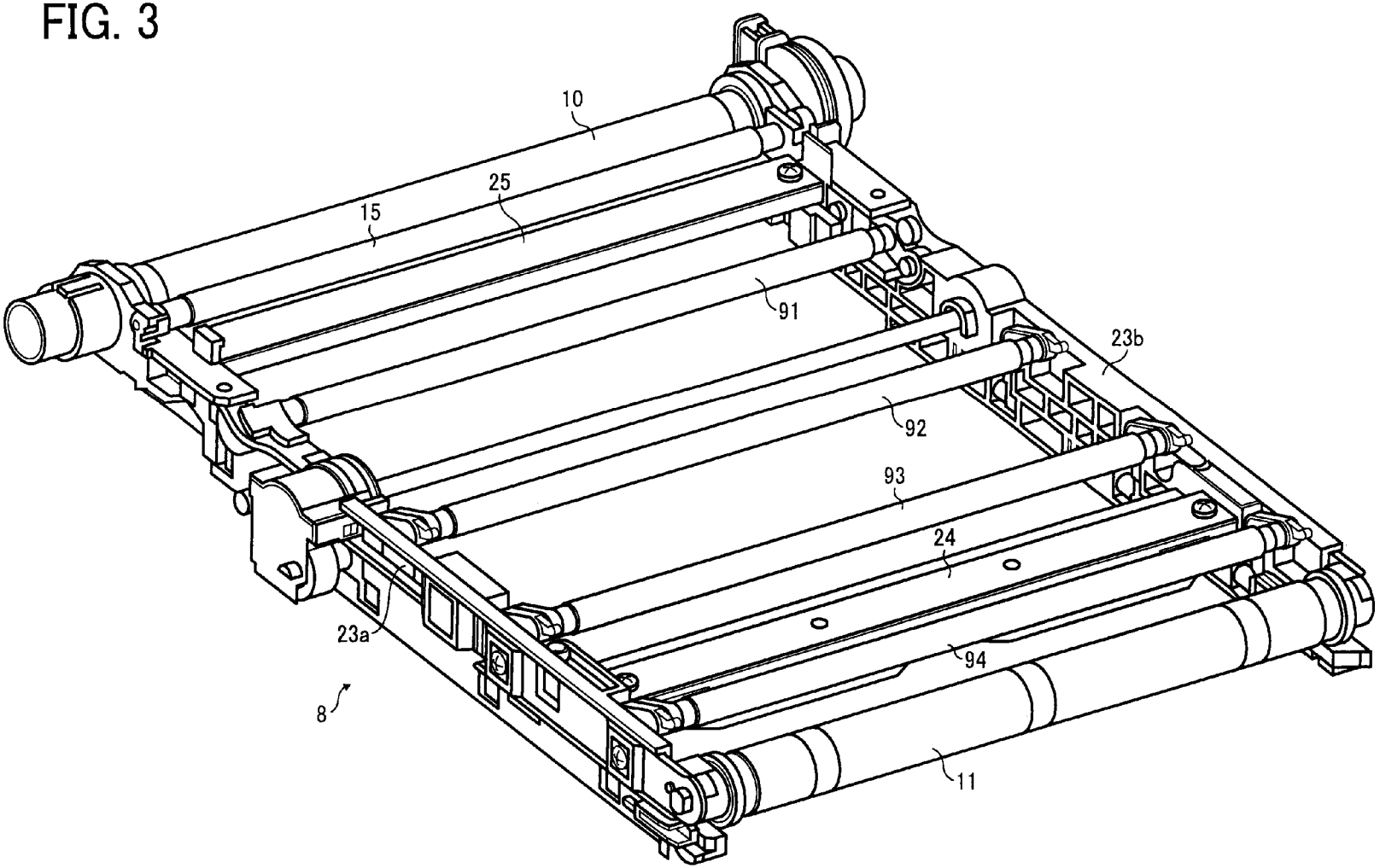
FIG. 3 is a schematic diagram for explaining a status when a transfer belt is removed from the transfer belt device shown in FIG. 2.

FIG. 2 is a schematic diagram of the transfer belt device 8 according to the embodiment. FIG. 3 is a schematic diagram for explaining a status when the transfer belt 12 and the belt cleaning unit 14 are removed from the transfer belt device 8. As shown in FIG. 2, a dimensional ratio, which is set for the transfer belt device 8, is high on a length direction that is indicated by an arrow X, and high on a width direction that is indicated by an arrow Y. Furthermore, the dimensional ratio set for the transfer belt device 8 is low on a thickness direction that is indicated by an arrow Z.

In FIG. 3, the transfer belt device 8 includes a pair of resin-made supporting members 23*a* and 23*b*. The supporting members 23*a* and 23*b* is a rectangular cross section channel. In the vicinity of both ends of the supporting members 23*a* and 23*b*, the supporting members 23*a* and 23*b* are connected by two metallic connecting members 24 and 25. Both ends of the tension roller 11 are rotatably supported at end portions of the supporting members 23*a* and 23*b* that are shown on front side in FIG. 3. Both ends of the driving roller 10 are rotatably supported at end portions shown on backside in FIG. 3. Furthermore, between the tension roller 11 and the driving roller 10, four primary transfer rollers 91 to 94 and the cleaning backup roller 15 are rotatably supported. When the transfer belt device 8 is fixed to the main body of the image forming apparatus, the supporting members 23*a* and 23*b*, and a plurality of rollers such as the tension roller 11 are positioned in a horizontal direction (see FIG. 1).

Figure 4:
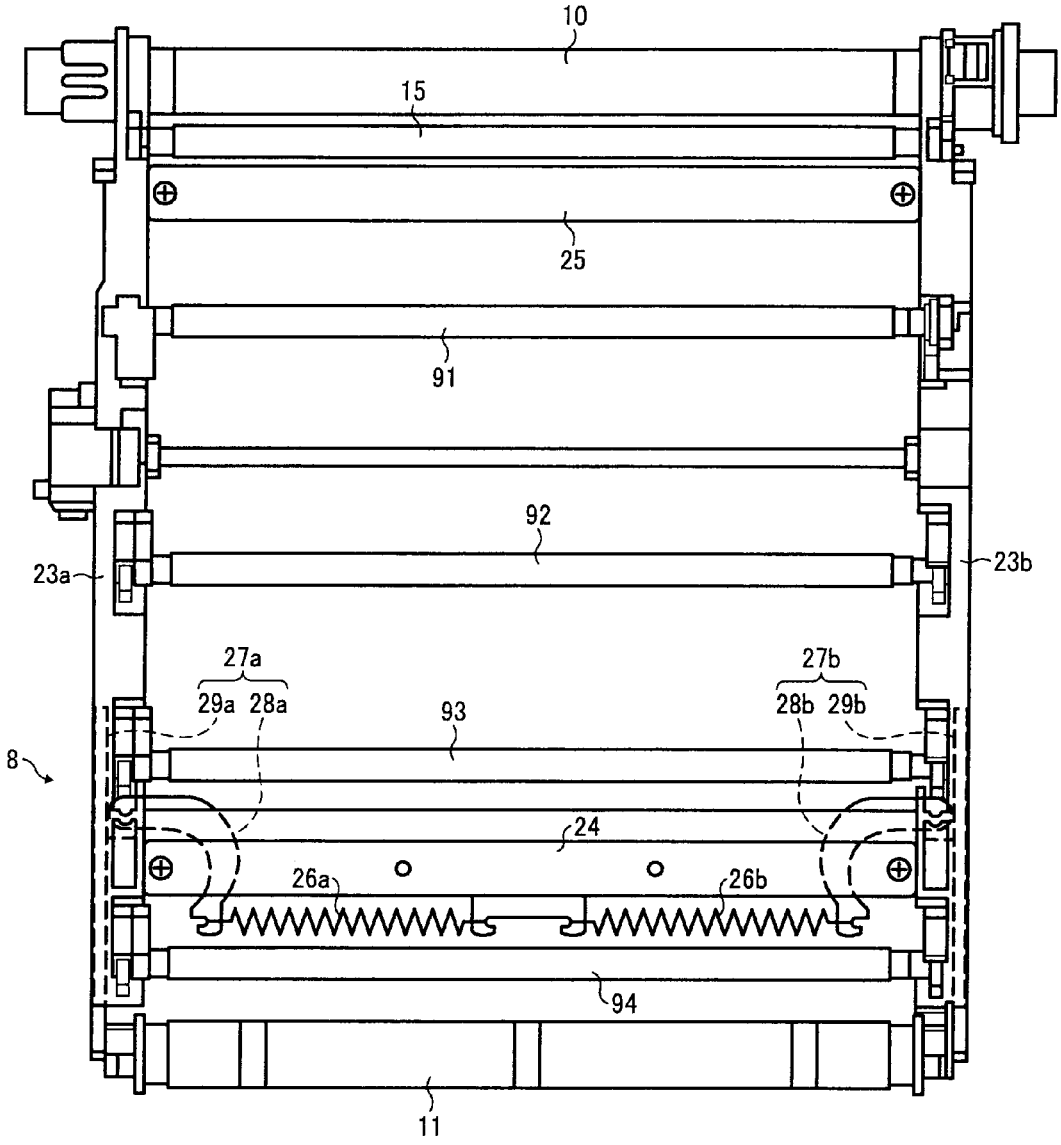
FIG. 4 is a schematic diagram for explaining a top view of the transfer belt device shown in FIG. 3.

FIG. 4 is a schematic diagram for explaining a top view of the transfer belt device 8 shown in FIG. 3. As shown in FIG. 4, the transfer belt device 8 includes a pair of biasing members 26*a* and 26*b* and a pair of link units 27*a* and 27*b* for biasing both the ends of the tension roller 11 in a downward direction shown in FIG. 3 (a straight-line direction nearly parallel to a plane portion of the transfer belt 12). The plane portion of the transfer belt 12 indicates an area that corresponds to an extended surface of the transfer belt 12 shown in FIG. 2 facing a plurality of image carriers 2.

The biasing members 26*a* and 26*b* are positioned in a direction in which the biasing members 26*a* and 26*b* traverse from one supporting member 23*a* (23*b*) to the other supporting member 23*a* (23*b*). In the embodiment, the biasing members 26*a* and 26*b*, which are coil springs, are positioned at a right angle with respect to the supporting members 23*a* and 23*b*. A biasing force of the coil springs is not significantly affected by variations in the dimensional tolerance of components and positioning accuracy errors. Thus, the springs having the low spring constant are used as the coil springs.

The link units 27*a* and 27*b* include rotating members 28*a* and 28*b* that are respectively curved in nearly C shape and long holding members 29*a* and 29*b*. As shown in FIG. 4, in a plane view of the transfer belt device 8, the biasing members 26*a* and 26*b* and the rotating members 28*a* and 28*b* are positioned between the primary transfer rollers 94 and 93 that are respectively on a first and a second position when counted from the tension roller 11.

A structure of the biasing members 26*a* and 26*b*, the rotating members 28*a* and 28*b*, and the holding members 29*a* and 29*b* is explained below in detail. The transfer belt device 8 is centered across the width, thereby forming a symmetric structure. Thus, only one side of the structure is explained.

Figure 5:
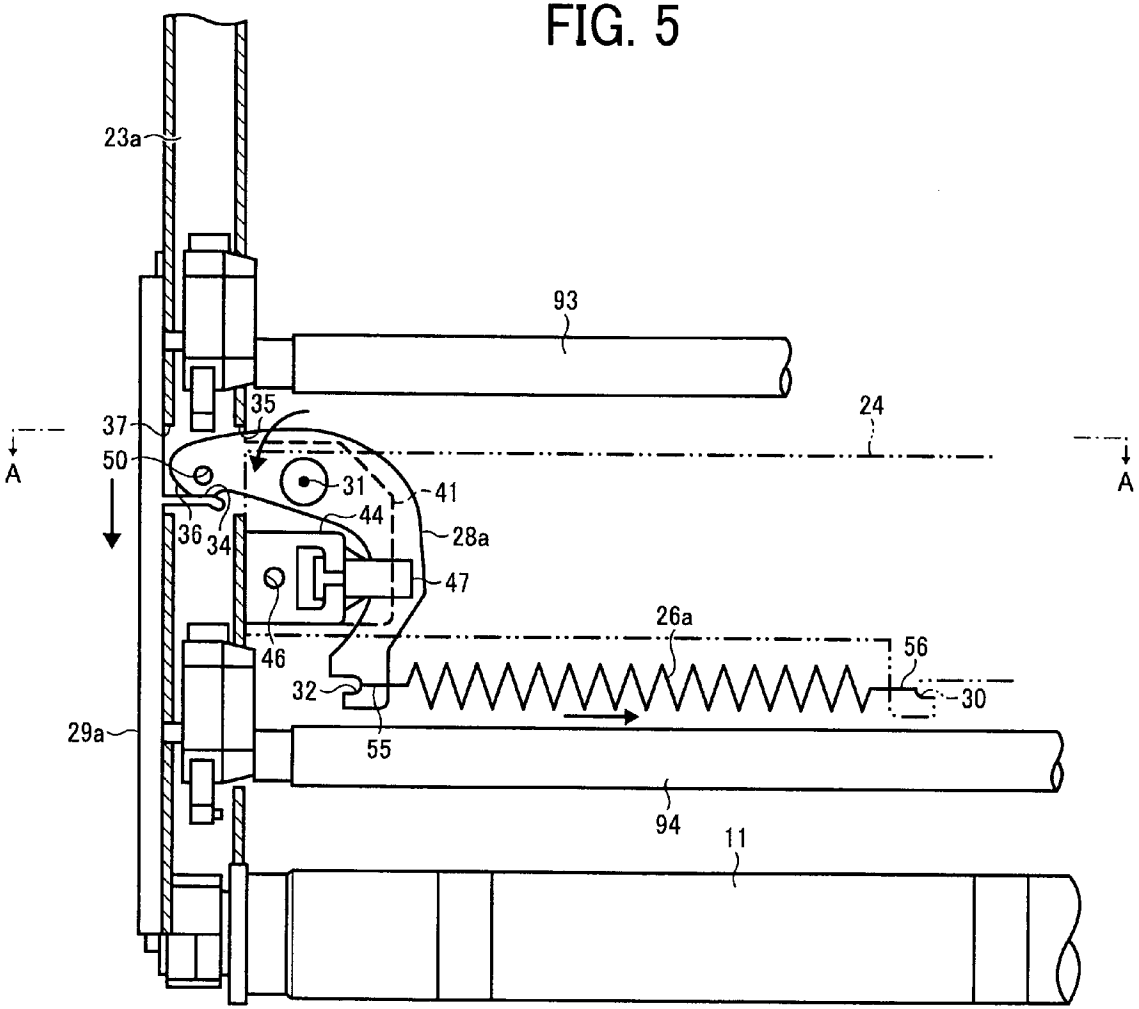
FIG. 5 is a schematic diagram of the transfer belt device for explaining main components shown in FIG. 4.

In FIG. 5, the supporting member 23*a*, the biasing member 26*a*, the rotating member 28*a*, and the holding member 29*a* shown on the left side in FIG. 4 are explained. In FIG. 5, a right side of the supporting member 23*a* is called an inner side and a left side is called an outer side. The rotating member 28*a* is centered on a rotating shaft 31 and is rotatably positioned against the supporting member 23*a*. On an end portion of the rotating member 28*a*, which is on the inner side, a hook-like holding unit 32 is formed. The holding unit 32 holds a ring-shaped one end 55 of the biasing member 26*a*. Furthermore, a hook-like holding unit 30 that is positioned in the middle of the connecting member 24 holds a ring-shaped other end 56 of the biasing member 26*a*. Apart from the ring-shape and the hook-like holding structures, a locking structure between the hooks or another common holding structure can be used as the holding structure for both the ends of the biasing member 26*a*, the rotating member 28*a*, and the connecting member 24.

The other end portion of the rotating member 28*a* is positioned by penetrating inside from an internal window 35 that is formed on an inner side surface of the supporting member 23*a*. The rotating member 28*a* includes a cam 36 that is formed in curved shape on an edge of the other end of the rotating member 28*a*.

Figure 6:
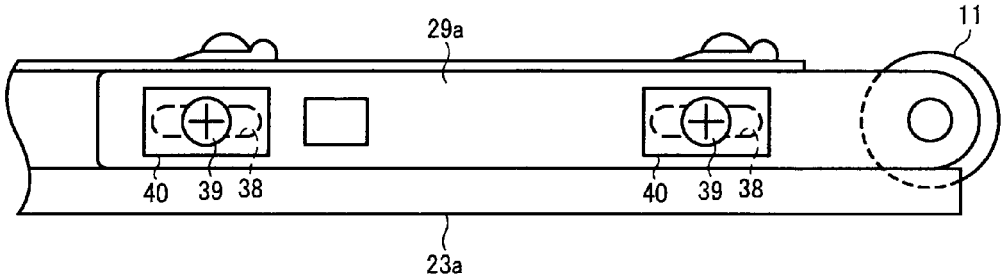
FIG. 6 is a schematic diagram for explaining a fixing structure of a holding member.

The holding member 29*a* is a metallic long member. One end of the tension roller 11 is rotatably attached to an end portion of the holding member 29*a* shown on a lower side in FIG. 5. The holding member 29*a* is attached to an outer side surface of the supporting member 23*a* such that the holding member 29*a* can slide in a longitudinal direction of the supporting member 23*a*. Thus, by connecting the tension roller 11 to the sliding holding member 29*a*, the tension roller 11 can move in the straight-line direction. To be specific, as shown in FIG. 6, two long holes 38 are formed on the holding member 29*a* in the longitudinal direction. Fasteners 39 such as screws are inserted into the long holes 38 from outside and tips of the fasteners 39 are fixed to the supporting member 23*a*. In FIG. 6, a reference numeral 40 is a pressing member that presses the holding member 29*a* from outside. Due to the fasteners 39, the pressing member 40 is pressed towards the holding member 29*a*.

Returning to FIG. 5, the holding member 29*a* includes a cam receiving unit 34 that is protruded on the supporting member 23*a* side. The cam receiving unit 34 is positioned by penetrating inside from an outer window 37 that is formed on the outer side surface of the supporting member 23*a*. The holding member 29*a* is slidably arranged in a range in which the cam receiving unit 34 can move inside the outer window 37 in the vertical direction shown in FIG. 5. The cam 36 of the rotating member 28*a* is positioned on the cam receiving unit 34 such that the cam 36 can contact the cam receiving unit 34.

Figure 7:
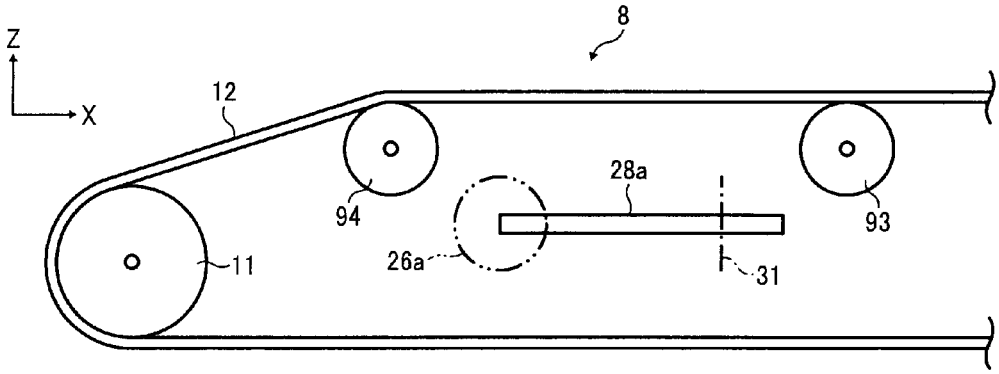
FIG. 7 is a schematic diagram of the transfer belt device.

As shown in FIG. 7, when the transfer belt 12 is fixed to the tension roller 11, the primary transfer rollers 94 and 93, the rotating member 28*a* faces an inner surface of the plane portion (extended portion) of the transfer belt 12 that is extended between the primary transfer rollers 94 and 93. The rotating member 28*a* is also formed in a plate shape that is nearly parallel to the inner surface of the transfer belt 12. Furthermore, the rotating member 28*a* is positioned such that the rotating member 28*a* rotates nearly parallel to the plane portion. In the embodiment, although the rotating member 28*a* is positioned nearly parallel to the plane portion on an upper side and a lower side of the transfer belt 12, the rotating member 28*a* can be positioned nearly parallel to any one of the plane portions or the plane portion of the transfer belt 12 that is close to the rotating member 28*a*.

In FIG. 7, the biasing member 26*a* is positioned in a flat space formed in between the transfer belt 12. Similarly as the rotating member 28*a*, the biasing member 26*a* is positioned such that the biasing member 26*a* is nearly parallel to the plane portion of the transfer belt 12.

Figure 8:
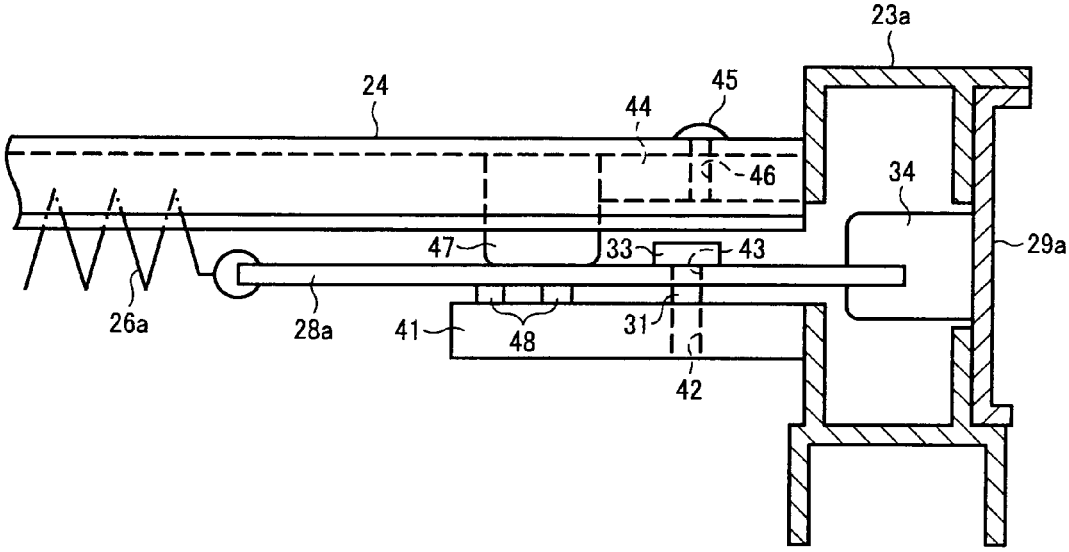
FIG. 8 is a schematic diagram for explaining the main components of the transfer belt device in an arrow direction A-A shown in FIG. 5.

FIG. 8 is a schematic diagram for explaining the main components of the transfer belt device 8 in an arrow direction A-A shown in FIG. 5. As shown in FIG. 8, a fixing unit 41 is integrally positioned in a protruding manner on the inner side of the supporting member 23*a*. The connecting member 24 is positioned across on an upper side of the fixing unit 41 that is shown in FIG. 8 and the rotating member 28*a* is positioned between the fixing unit 41 and the connecting member 24. By inserting the rotating shaft 31 into a through-hole 43, which is formed on the rotating member 28*a*, and an insertion hole 42, which is formed on the fixing unit 41, the rotating member 28*a* is rotatably attached. On an upper end of the rotating shaft 31 that is shown in FIG. 8, a radially expanded head 33 is arranged. Because the head 33 is interfering with an upper surface of the rotating member 28*a* that is shown in FIG. 8, falling down of the rotating shaft 31 is prevented. The connecting member 24 is positioned facing the head 33 of the rotating shaft 31. The connecting member 24 and the head 33 are positioned such that the connecting member 24 interferes with the head 33 until the rotating shaft 31 is separated in an upward direction shown in FIG. 8 from the insertion hole 42. In FIG. 8, the head 33 does not come into contact with the connecting member 24. However, the connecting member 24 can be positioned by causing the connecting member 24 to come into contact with the head 33.

It is desirable to use a material of high abrasion resistance such as a metal for the rotating shaft 31. The rotating shaft 31 abrades by sliding with the rotating member 28*a*, thus deforming the rotating shaft 31 and increasing the sliding resistance, thereby causing fluctuations in the biasing force. However, using the material of high abrasion resistance enables to prevent the fluctuations. Furthermore, for preventing abrasion that occurs due to sliding of the rotating member 28*a* with the rotating shaft 31, the rotating shaft 31 can be pressed onto the rotating member 28*a* and a single unit can be formed.

In FIG. 8, on the upper side of the fixing unit 41, an attaching unit 44 is integrally positioned in a protruding manner on the inner side of the supporting member 23*a*. A screw hole 46 is formed on the attaching unit 44 and the connecting member 24 is fixed by inserting a screw 45 into the screw hole 46.

Posture maintaining members 47 and 48 are respectively attached to the attaching unit 44 and the fixing unit 41. The posture maintaining member 47 is attached to the attaching unit 44 such that the posture maintaining member 47 touches the upper surface of the rotating member 28*a* that is shown in FIG. 8. The attaching unit 44 and the posture maintaining member 47 are fixed by using a protruding unit and a concave unit that can fit with each other (see FIG. 5).

However, the posture maintaining members 48 attached to the fixing unit 41 are formed of two small projections. Tips of the small projections touch a lower surface of the rotating member 28*a* that is shown in FIG. 8. The posture maintaining members 48 can be formed of more than or equal to three protrusions. Furthermore, the posture maintaining member 47 shown on an upper side in FIG. 8 can be formed of a plurality of projections.

Figure 9:
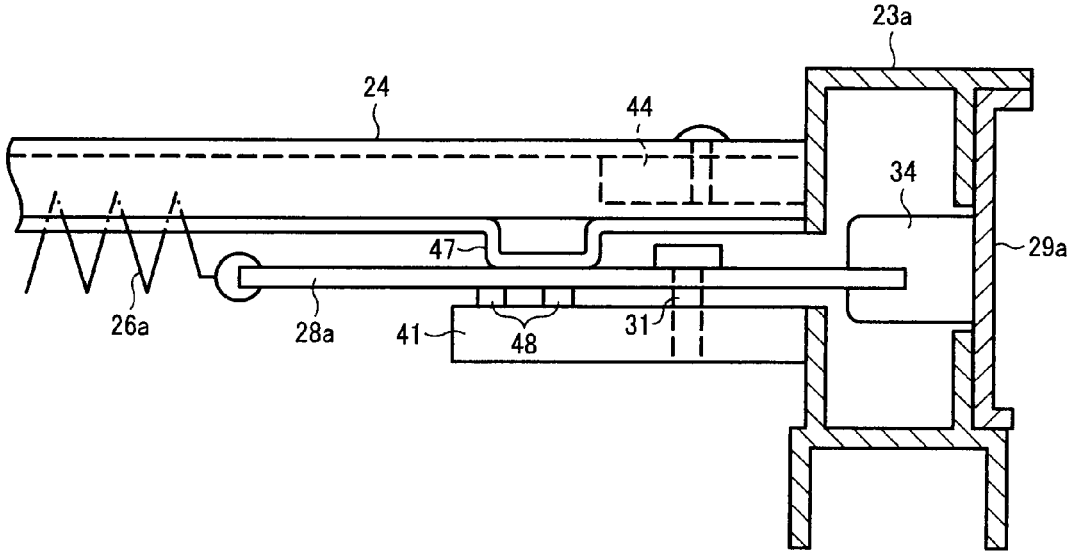
FIG. 9 is a schematic diagram for explaining modification of the transfer belt device in the arrow direction A-A shown in FIG. 5.

As shown in FIG. 9, the posture maintaining member 47 can be integrally formed on the connecting member 24. In the present embodiment, by pressing a portion of the metallic connecting member 24 and causing the portion to protrude, the posture maintaining member 47 is formed.

Figure 10:
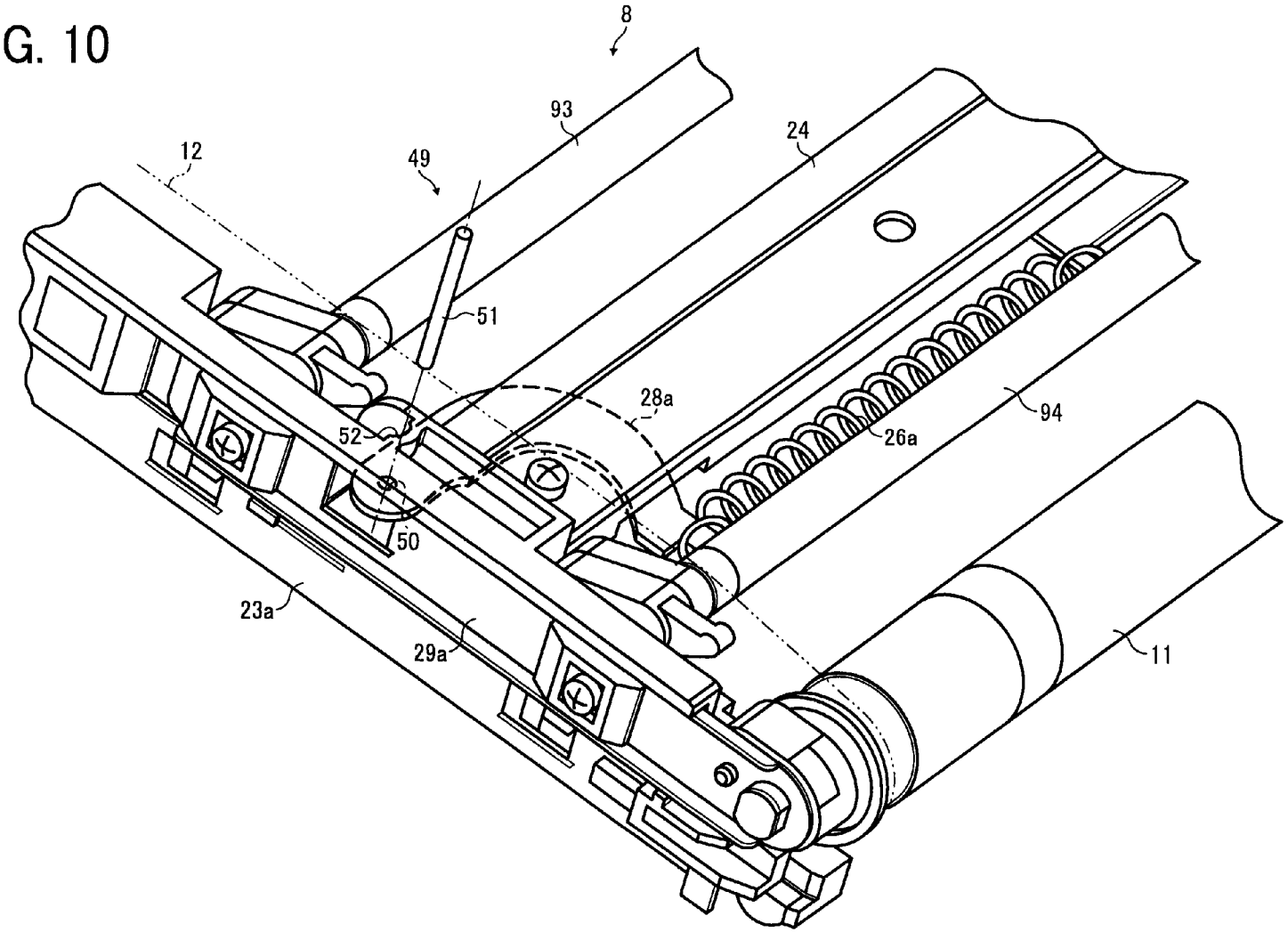
FIG. 10 is a schematic diagram for explaining a position holding unit of the transfer belt device.

As shown in FIG. 10, the transfer belt device 8 according to the embodiment includes a position holding unit 49 that indirectly holds the tension roller 11 in a predetermined position by resisting the biasing force of the biasing member 26*a*. The position holding unit 49 includes a hole 50 that is formed on the rotating member 28*a*, a shaft member 51 that can be inserted into and removed from the hole 50, and a shaft holding unit 52 that is formed on the rotating member 28*a*. The hole 50 is formed at an end portion of the rotating member 28*a* and is penetrated in the supporting member 23*a*. The shaft holding unit 52 is a groove of a shape that corresponds with an outer peripheral shape of the shaft member 51. The hole 50 and the shaft holding unit 52 are positioned such that the hole 50 and the shaft holding unit 52 are coaxially aligned. In FIG. 10, a dashed-two dotted line indicates an end edge of the transfer belt 12. The shaft holding unit 52 is positioned towards outer side from the end edge of the transfer belt 12.

Figure 11:
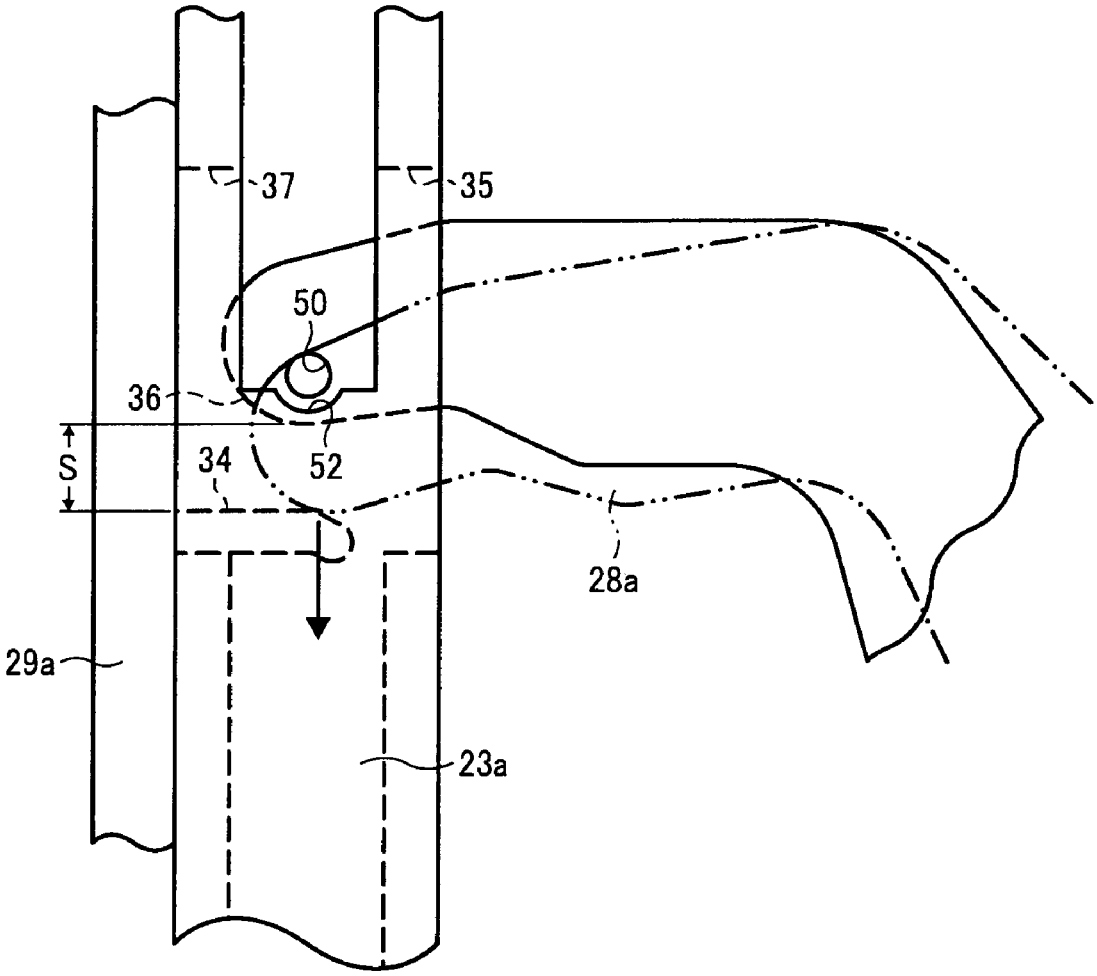
FIG. 11 is a schematic diagram for explaining main components of the transfer belt device shown in FIG. 10.

As shown in FIG. 11, upon the cam receiving unit 34 receiving a suppress strength from the cam 36 of the rotating member 28*a*, the cam receiving unit 34 can move until the cam receiving unit 34 comes into contact with an edge of the outer window 37 shown on a lower side in FIG. 11. In other words, the dashed-two dotted line in FIG. 11 indicates that the rotating member 28*a* is maximally rotated in a direction in which the biasing force acts. When the rotating member 28*a* is marginally moved, from the maximally rotated condition, in an opposite direction (clockwise) of the direction of the biasing force indicated by an arrow shown in FIG. 11, the shaft holding unit 52 is positioned such that the shaft holding unit 52 and the hole 50 of the rotating member 28*a* are coaxially aligned. In other words, when the hole 50 and the shaft holding unit 52 are coaxially aligned, the rotating member 28*a* (cam 36) and the cam receiving unit 34 are positioned such that a gap S generates between the rotating member 28*a* (cam 36) and the cam receiving unit 34. Thus, because the biasing member 26*a* is in a stop state, assembling properties are enhanced.

Figure 12:
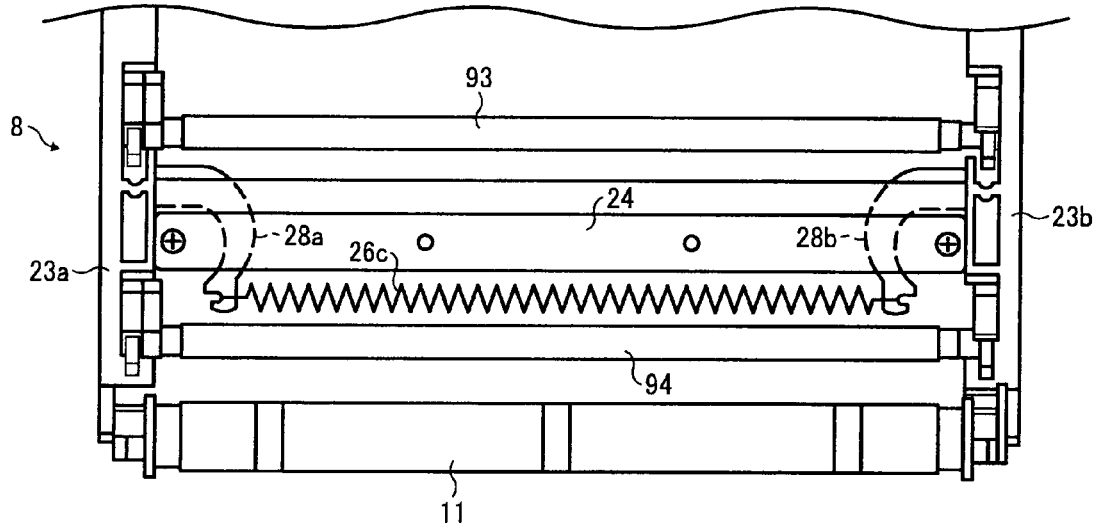
FIG. 12 is a schematic diagram of a transfer belt device for explaining another embodiment of the present invention.

FIG. 12 is a schematic diagram of the transfer belt device 8 for explaining another embodiment of the present invention. As shown in FIG. 12, the rotating members 28*a* and 28*b* is connected by using one biasing member 26*c*, which is common. As compared to the embodiment shown in FIG. 4, in the embodiment shown in FIG. 12, variations in the biasing force that is applied on both the ends of the tension roller 11 can be restrained. Furthermore, as shown in FIG. 12, by positioning the long spring as the biasing member 26*c*, a spring having a lower spring constant can be used. Due to this, receiving the effects due to variations in the dimensional tolerance is very difficult.

Figure 13:
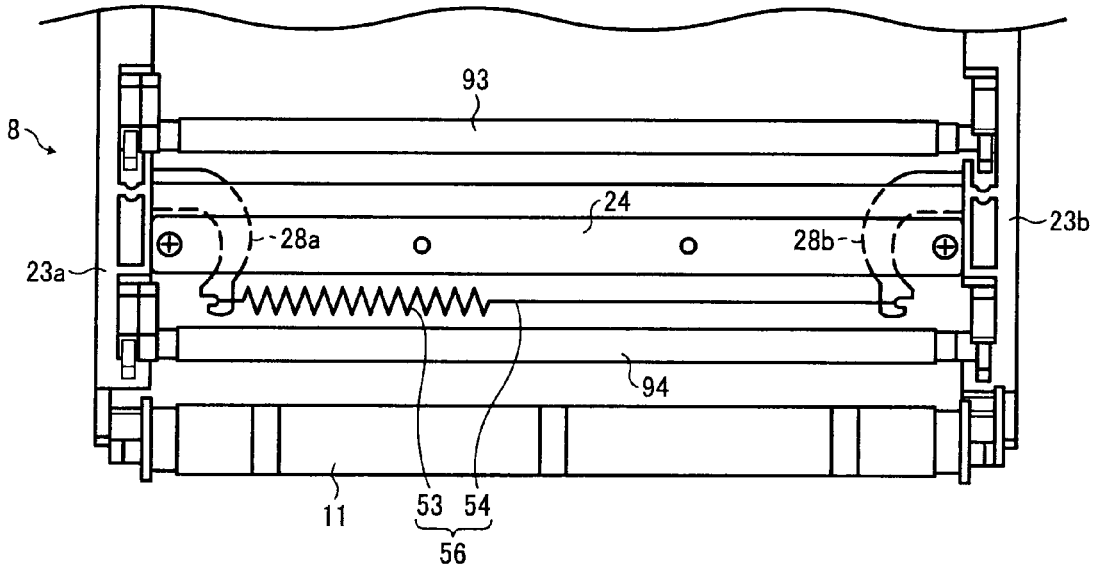
FIG. 13 is a schematic diagram of a transfer belt device for explaining yet another embodiment of the present invention.

FIG. 13 is a schematic diagram of the transfer belt device 8 for explaining yet another embodiment of the present invention. A biasing member 26*d* according to the embodiment of the present invention includes a biasing force generating unit 53 and a connecting unit 54 stretched in the longitudinal direction from the biasing force generating unit 53. For example, the biasing force generating unit 53 is a coiled spring portion and the connecting unit 54 is a straight-line wire portion that is extended from the coiled spring portion. An end portion on the biasing force generating unit 53 side and an end portion on the connecting unit 54 side are connected to the rotating members 28*a* and 28*b*. In the embodiment shown in FIG. 13, because both the ends of the tension roller 11 are biased by using the common biasing member 26*d*, variations in the biasing force that is applied on both the ends of the tension roller 11 can be restrained. As compared to the embodiment shown in FIG. 12, in the embodiment shown in FIG. 13, because a short coiled spring portion is used, a cost can be reduced. Furthermore, connecting units 54 can be positioned on both ends of the biasing force generating unit 53.

Figure 14:
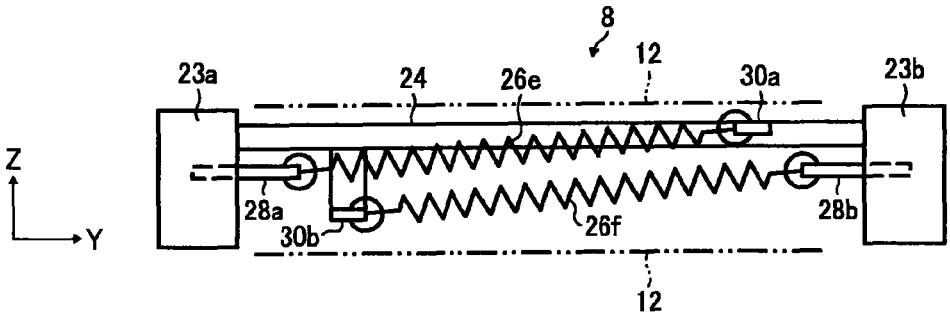
FIG. 14 is a schematic diagram for explaining another method for positioning biasing members.

A pair of biasing members 26*e* and 26*f* can be positioned as shown in FIG. 14. FIG. 14 is a schematic diagram of the transfer belt device 8 according to an embodiment of the present invention when viewed from a front face. In other words, in FIG. 14, the arrow Y and the arrow Z respectively represent the width direction and the thickness direction that is similar to the width direction and the thickness direction shown in FIG. 2. Dashed-two dotted lines on an upper side and on a lower side indicate a cross section of the transfer belt 12. As shown in FIG. 14, the biasing members 26*e* and 26*f* is respectively positioned by inclining with respect to the cross section of the transfer belt 12. Two holding units 30*a* and 30*b* are arranged on the connecting member 24. The holding units 30*a* and 30*b* are positioned on different heights in the thickness direction Z. The biasing member 26*e* is arranged between the holding unit 30*a* and the rotating member 28*a* that is separated from the holding unit 30*a*. The biasing member 26*f* is arranged between the holding unit 30*b* and the rotating member 28*b* that is separated from the holding unit 30*b*. The biasing members 26*e* and 26*f* are positioned parallel to each other. By inclining a positioning direction of the biasing members 26*e* and 26*f*, the biasing members 26*e* and 26*f* can be elongated and positioned. Thus, the spring having the lower spring constant can be used and receiving the effects due to variations in the dimensional tolerance becomes very difficult. Furthermore, both ends of the biasing members 26*e* and 26*f* can be shifted in the longitudinal direction of the supporting members 23*a* and 23*b* and can be diagonally positioned with respect to the supporting members 23*a* and 23*b* (not shown in FIG. 14).

In the structure according to the embodiment of the present invention, because the biasing member 26*a* is positioned in a traverse direction, the biasing member 26*a* can be elongated and positioned in the flat space in between the transfer belt 12. Due to this, the spring having the low spring constant can be used as the biasing member 26*a*. Thus, the biasing member 26*a* is not significantly affected by variations in the dimensional tolerance of the components and the positioning accuracy errors. Furthermore, as shown in FIG. 7, the rotating member 28*a* is positioned such that the rotating member 28*a* rotates nearly parallel to the plane portion of the transfer belt 12. Due to this, the flat space in between the transfer belt 12 can be designed by reducing the flat space in the thickness direction Z. In FIG. 7, upon positioning the biasing member 26*a* and the rotating member 28*a* between the primary transfer rollers 93 and 94, the flat space can be further reduced in the thickness direction Z. Thus, by using the structure of the transfer belt device 8 according to the embodiment of the present invention, a degree of freedom for designing enhances.

Biasing actions on the tension roller 11 are explained in detail below. The biasing actions on both the ends of the tension roller 11 are same. Thus, the biasing action on one end of the tension roller 11 is explained as an example with reference to FIG. 5.

In FIG. 5, the biasing member 26*a* is fixed such that a constant contraction force is acting on the end of the tension roller 11. The end portion of the rotating member 28*a* that is connected to the biasing member 26*a* is stretched on a right side shown in FIG. 5 by using the biasing member 26*a*. Due to this, the rotating member 28*a* is centered on the rotating shaft 31 and is rotated in an anticlockwise direction.

Upon the rotating member 28*a* rotating in the anticlockwise direction, the cam 36 of the rotating member 28*a* presses the cam receiving unit 34 of the holding member 29*a* and the holding member 29*a* slides in a downward direction shown in FIG. 5 along the supporting member 23*a*. Due to this, the tension roller 11 attached to the holding member 29*a* also moves in the downward direction shown in FIG. 5. Thus, by biasing the tension roller 11 and causing the tension roller 11 to move in the downward direction shown in FIG. 5, the transfer belt 12 is pressed from the inner side and a tensile force is applied.

If the rotating member 28*a* is formed in a plate shape, which is thin in a rotating shaft direction, the rotating member 28*a* easily inclines with respect to the rotating shaft 31. If the rotating member 28*a* inclines with respect to the rotating shaft 31, the biasing force of the biasing member 26*a* is distributed to a not required vector. Due to this, variations occur in the biasing force on the tension roller 11 and friction between the rotating member 28*a* and the rotating shaft 31 increases. According to the embodiment of the present invention, during rotation of the rotating member 28*a*, the posture maintaining members 47 and 48 slidingly contact both surfaces of the rotating member 28*a* and support (see FIG. 8), thereby maintaining rotation posture of the rotating member 28*a*. Due to this, the problems such as variations in the biasing force on the tension roller 11 and increase in friction between the rotating member 28*a* and the rotating shaft 31 are prevented. In FIG. 8, the posture maintaining members 48 supporting the lower surface of the rotating member 28*a* are two small projections. By reducing a contact resistance between the two projections and the rotating member 28*a*, a smooth rotating movement can be maintained.

A method to assemble the transfer belt device 8 according to the embodiment of the present invention is explained below.

First, the rollers such as the driving roller 10, the primary transfer rollers 91 to 94 excluding the tension roller 11 are attached between the supporting members 23*a* and 23*b*. As shown in FIG. 8, the rotating member 28*a* is rotatably fixed to the fixing unit 41 of the supporting member 23*a*. The posture maintaining member 47 and the connecting member 24 are sequentially fixed to the attaching unit 44.

The rotating member 28*a* is centered on the rotating shaft 31 and rotated and as shown in FIG. 10, the hole 50 of the rotating member 28*a* is substantially coaxially aligned with the shaft holding unit 52 of the supporting member 23*a*. The shaft member 51 is inserted into the hole 50 of the rotating member 28*a* from the shaft holding unit 52. An end of the inserted shaft member 51 comes into contact with the supporting member 23*a* and a base end of the shaft member 51 stops in a status in which the base end of the shaft member 51 is slightly protruded from the shaft holding unit 52 (not shown in FIG. 10).

The holding unit 32 of the rotating member 28*a* and the holding unit 30 of the connecting member 24 hold both the ends of the biasing member 26*a* (see FIG. 5). When the holding unit 32 of the rotating member 28*a* and the holding unit 30 of the connecting member 24 hold both the ends of the biasing member 26*a*, the biasing force generates on the biasing member 26*a* in a contraction direction and the biasing force acts on the rotating member 28*a*. However, because the shaft holding unit 52 holds the shaft member 51 inserted into the rotating member 28*a* by resisting the biasing force, the rotating member 28*a* is held at the predetermined position.

Similarly as on the supporting member 23*a* side, each member on the supporting member 23*b* side is assembled, and by resisting the biasing force of the biasing member 26*b*, a position of the rotating member 28*b* is held.

Figure 15:
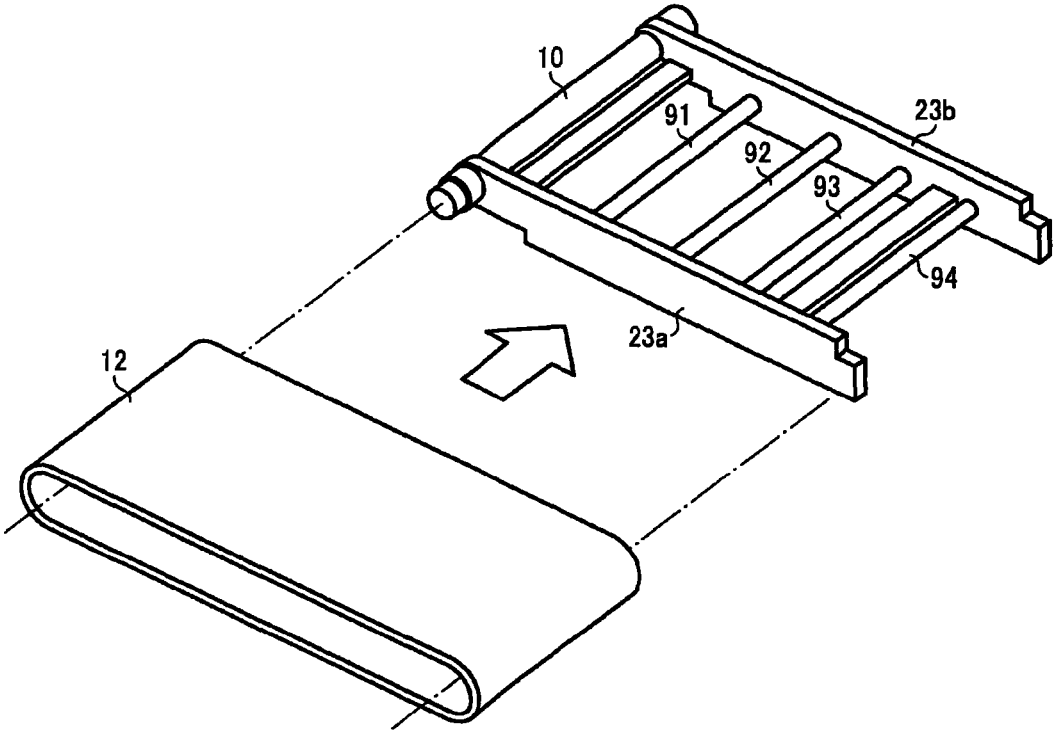
FIG. 15 is a schematic diagram for explaining a method for fixing the transfer belt.

As shown in FIG. 15, the endless transfer belt 12 is caused to move in an axial direction that is indicated by an arrow in FIG. 15 and is fixed to an outer periphery of the rollers such as the driving roller 10 and the primary transfer rollers 91 to 94. The tension roller 11 is then inserted into the predetermined position on an inner side of the transfer belt 12 and the holding members 29*a* and 29*b* are attached to both the ends of the tension roller 11.

As shown in FIG. 5, the cam receiving unit 34 of the holding members 29*a* and 29*b* is inserted into the outer window 37 of the corresponding supporting members 23*a* and 23*b*. While inserting the cam receiving unit 34 into the outer window 37, the position of the rotating member 28*a* (28*b*) is held. Due to this, the cam receiving unit 34 is not pressed by the cam 36 and the cam receiving unit 34 can be easily positioned by facing the cam 36.

The fasteners 39 are fixed by pressing the holding members 29*a* and 29*b* by using the pressing member 40 and the holding members 29*a* and 29*b* are slidably fixed to the supporting members 23*a* and 23*b* (see FIG. 6).

Next, by removing the shaft member 51, the held position of the rotating members 28*a* and 28*b* is released. Upon releasing the held position, the rotating members 28*a* and 28*b* can be rotated by receiving the biasing force of the biasing members 26*a* and 26*b*. Due to the biasing action, the biasing force of the biasing members 26*a* and 26*b* is transferred to both the ends of the tension roller 11 via the rotating members 28*a* and 28*b* and the holding members 29*a* and 29*b* and the tensile force is applied to the transfer belt 12.

In the transfer belt device according to the embodiment of the present invention, if the transfer belt includes inside the biasing members and the rotating members, the biasing members and the rotating members need to be fixed before fixing the transfer belt to the rollers. However, when the biasing force of the biasing member acts on the rotating members, fixing the holding members and tension roller or the transfer belt becomes difficult. Using the assembling method, by temporarily holding the position of the rotating members by using the shaft member, fixing the holding members, tension roller, and the transfer belt is easy. Furthermore, because the shaft member is positioned outside the transfer belt, by easily removing (operating) the shaft member after the transfer belt is fixed, the fixed rotating members can be released.

For explaining the assembling method, the assembling method of the transfer belt device 8 according to the embodiment of the present invention is explained as the example. An assembling sequence can be changed without departing from the spirit or scope of the present invention. For example, upon inserting the shaft member 51 into the rotating members 28*a* and 28*b* and holding at the predetermined position, the transfer belt 12 can be fixed by attaching the holding members 29*a* and 29*b* and the tension roller 11 to the supporting members 23*a* and 23*b*.

While fixing the transfer belt 12 to the outer periphery of the rollers such as the driving roller 10 and the primary transfer rollers 91 to 94, it is desirable to reduce an amount of protrusion of the shaft member 51 from the supporting members 23*a* and 23*b* such that the transfer belt 12 does not get hitched to the shaft member 51. If the transfer belt 12 is hitched to the shaft member 51, it is desirable to form the end portion of the shaft member 51 protruding from the supporting members 23*a* and 23*b* in a spherical surface such that the transfer belt 12 does not get damaged. Furthermore, the position holding unit 49 to which the tension roller 11 is directly fixed can be arranged.

The embodiment when the transfer belt device according to the embodiment of the present invention is applied in the image forming apparatus that uses the indirect transfer system is explained. However, the structure according to the embodiment of the present invention is similarly applicable to the image forming apparatus that uses the direct transfer system. The direct transfer system includes the transfer belt that conveys the sheet on which the image is to be transferred by causing the sheet to be adsorbed on a belt surface.

Biasing members are positioned in a direction in which the biasing members traverse from one supporting member to the other supporting member. Thus, a long biasing member can be positioned between rollers by avoiding interference with the rollers. In other words, without increasing a space in between an existing transfer belt, the biasing member that is not significantly affected by variations in the dimensional tolerance of components and positioning accuracy errors can be used. Furthermore, by narrowing the space in between the transfer belt, the transfer belt device can be miniaturized. Thus, by using a structure according to an embodiment of the present invention, degree of freedom for changing a design of the transfer belt device is enhanced.

By using link units, a direction of a biasing force of the biasing members can be changed and the biasing force can be transferred to a tension roller. By biasing both ends of the tension roller, the tension roller can be stably biased in a predetermined direction.

The link units include a pair of holding members and a pair of rotating members. Due to this, the direction of the biasing force of the biasing members can be changed and the biasing force can be transferred to the tension roller. The tension roller can be stably biased in the predetermined direction.

A narrow space can be formed in between the transfer belt in a direction orthogonal to a plane portion.

Connecting members can function as retaining members of a rotating shaft. Due to this, arranging the separate retaining member of the shaft member is not necessary. Thus, by reducing components count, a manufacturing cost can be reduced.

During rotation of the rotating member, posture maintaining members slidingly contact both surfaces of the rotating member and support. Thus, a rotation posture of the rotating member is maintained. Due to this, inclination of the rotating member with respect to the rotating shaft can be prevented. By distributing the biasing force of the biasing members to a not required vector, problems such as variations in the biasing force on the tension roller can be resolved.

A separate member needs not to be positioned for attaching the posture maintaining members. Thus, by reducing the components count, the manufacturing cost can be reduced.

In a structure according to the embodiment of the present invention in which the biasing members are positioned on the inner side of the transfer belt, it is necessary to fix the biasing members before fixing the transfer belt to a plurality of rollers. By fixing the biasing members, although the tension roller is biased, a position holding unit can temporarily hold a position of the tension roller. Thus, by holding the position of the link units, attaching the tension roller or fixing the transfer belt to the rollers can be easily carried out. Upon fixing the transfer belt, if the held position of the link units is released, the tension roller is biased and a tensile force is applied to the transfer belt.

A shaft holding unit holds an insertion shaft that is inserted into a hole of the rotating members by resisting the biasing force of the biasing members. Due to this, the position of the rotating members can be temporarily held. Thus, the holding members can be positioned such that the holding members can be engaged with the rotating members. Upon fixing the transfer belt, if the held position of the rotating members is released by removing the shaft member, the tensile force is applied to the transfer belt.

The shaft holding unit is formed on a portion of the supporting member that is outside the transfer belt. Thus, the fixed transfer belt is not disturbed by a removal operation of the shaft member and the transfer belt is also not likely to get damaged while removing the shaft member.

Variations in the biasing force that is applied on both the ends of the tension roller can be restrained.

Variations in the biasing force that is applied on both the ends of the tension roller can be restrained and a cost of the biasing members can be reduced.

The transfer belt device according to any one of claims 1 to 11 can be applied in an image forming apparatus.

When the position of the link units is temporarily held and the link units are not biased, the tension roller and the transfer belt can be easily fixed.

Upon fixing the transfer belt, held position of the link units can be released by easily operating the position holding unit from the outer side of the transfer belt. Due to this, the fixed transfer belt is not disturbed by the removal operation of the shaft member and the transfer belt is not likely to get damaged while removing the shaft member.

As described above, according to an aspect of the present invention, biasing members can be effectively positioned in a dead space that is on an inner side of a transfer belt. Due to this, a degree of freedom for changing a design of the transfer belt device is enhanced. For example, designing such as using a long biasing member for improving a running stability of the transfer belt and a miniaturizing the transfer belt device by narrowing a space in between the transfer belt becomes easy.

Furthermore, according to another aspect of the present invention, effects same as that of the transfer belt device mentioned earlier can be obtained.

Moreover, according to still another aspect of the present invention, by holding at a predetermined position, link units on which the biasing force acts, a tension roller and the transfer belt can be easily positioned.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A transfer belt device comprising:

a plurality of rollers arranged in parallel including a tension roller;

a pair of supporting members that supports both ends of the rollers;

a transfer belt that is supported by the rollers;

a biasing member that applies a tension to the transfer belt by biasing the tension roller in a predetermined direction; and a linking unit including a pair of holding members that is slidably arranged, and supports both ends of the tension roller, on the supporting members, and a pair of rotating members that slide the holding members along the supporting members such that the tension roller moves in a straight-line direction, wherein the biasing member is arranged in an area surrounded by the supporting members and the transfer belt in a direction of traversing from one of the supporting members to the other one of the supporting members.

2. The transfer belt device according to claim 1, wherein the biasing member biases both ends of the tension roller in the predetermined direction via the link unit.

3. The transfer belt device according to claim 2, wherein the pair of rotating members is rotatably arranged on the supporting members, and transfers a biasing force of the biasing member in a direction of supporting the transfer belt by making an engagement with the biasing member and the holding members.

4. The transfer belt device according to claim 3, wherein the rotating members are formed in a plate shape nearly parallel to a plane portion of the transfer belt, and the rotating members are rotatably arranged nearly parallel to the plane portion of the transfer belt.

5. The transfer belt device according to claim 3, wherein the supporting members are connected by a connecting member, the rotating members are arranged between the connecting member and a fixing unit that is arranged on an inner side of the supporting members, a tip of a rotating shaft of the rotating member is inserted into an insertion hole formed on the fixing unit, and the connecting member is arranged such that a base end of the rotating shaft interferes with the connecting member until the rotating shaft is separated from the insertion hole.

6. The transfer belt device according to claim 3, further comprising posture maintaining members that contact with two surfaces of one of the rotating members, which are orthogonal to a rotating shaft.

7. The transfer belt device according to claim 6, wherein the supporting members are connected by connecting members, and the posture maintaining members are respectively arranged on the connecting members and a fixing unit that is arranged on an inner side of the supporting members.

8. The transfer belt device according to claim 1, further comprising a position holding unit that directly or indirectly holds the tension roller in a predetermined position by resisting a biasing force of the biasing member.

9. The transfer belt device according to claim 3, further comprising a position holding unit that directly or indirectly holds the tension roller in a predetermined position by resisting a biasing force of the biasing member, wherein the position holding unit includes a hole formed on one of the rotating members, a shaft member that can be inserted into and removed from the hole, and a shaft holding unit that is formed on a portion of one of the supporting members that is outside the transfer belt and that can hold the shaft member.

10. The transfer belt device according to claim 3, further comprising a common biasing member connected to the rotating members.

11. The transfer belt device according to claim 10, wherein the common biasing member includes a biasing force generating unit and a connecting unit that is stretched in a longitudinal direction from the biasing force generating unit.

12. An image forming apparatus comprising a transfer belt device including a plurality of rollers arranged in parallel including a tension roller;

a pair of supporting members that supports both ends of the rollers;

a transfer belt that is supported by the rollers;

a biasing member that applies a tension to the transfer belt by biasing the tension roller in a predetermined direction; and a linking unit including a pair of holding members that is slidably arranged, and supports both ends of the tension roller, on the supporting members, and a pair of rotating members that slide the holding members along the supporting members such that the tension roller moves in a straight-line direction, wherein the biasing member is arranged in an area surrounded by the supporting members and the transfer belt in a direction of traversing from one of the supporting members to the other one of the supporting members.

13. A method of assembling a transfer belt device that includes a transfer belt supported on a plurality of rollers including a tension roller arranged in parallel on a pair of supporting members, the method comprising:

linking a biasing member arranged in an area surrounded by prior arrangement positions of the supporting members and the transfer belt in a direction of traversing from one of the pair of supporting members to the other one of the pair of supporting members and a link unit, the link unit including a pair of holding members that is slidably arranged, and supports both ends of the tension roller, on the supporting members and a pair of rotating members that slide the holding members along the supporting members such that the tension roller moves in a straight-line direction;

holding the link unit in a predetermined position resisting a biasing force of the biasing member by a position holding unit;

linking the tension roller to the link unit in a state in which the link unit is held in a predetermined position;

arranging the transfer belt on outer peripheries of the rollers including the tension roller;

releasing a held position of the link unit after arranging the transfer belt on the outer peripheries of the rollers; and applying a tension to the transfer belt by the biasing force of the biasing member being transferred to the tension roller upon releasing the held position of the link unit.

14. The method according to claim 13, further comprising releasing the held position of the link unit after arranging the transfer belt on the outer peripheries of the rollers by operating the position holding unit on an outer side of the transfer belt.

* * * * *